US005170644A

United States Patent [19]

Calabro

[11] Patent Number: 5,170,644

[45] Date of Patent: Dec. 15, 1992

[54] ADJUSTABLE PRESSURE EAR CLIP

[76] Inventor: Anthony S. Calabro, 51 Church Hill Dr., Cranston, R.I. 02920

[21] Appl. No.: 802,879

[22] Filed: Dec. 6, 1991

[51] Int. Cl.[5] ..... A44C 7/00

[52] U.S. Cl. ..... 63/14.4; 24/505; 24/518

[58] Field of Search ..... 63/14.1-14.5, 63/12; 24/499, 500, 505, 518

[56] References Cited

U.S. PATENT DOCUMENTS

| | | | |
|---|---|---|---|
| 1,908,469 | 5/1933 | Aanerud | 24/518 |
| 2,008,382 | 7/1935 | Bennett | 63/14.4 |
| 2,013,760 | 9/1935 | McSoley | 63/14.4 |
| 2,405,025 | 7/1946 | Feingold | 63/14.4 |
| 2,733,491 | 2/1956 | Saccoccio | 63/14.5 |
| 2,947,054 | 8/1960 | Adams | 63/14.4 |
| 3,020,734 | 2/1962 | Withers | 63/14.4 |
| 4,829,789 | 5/1989 | Tsamas | 63/14.5 |

FOREIGN PATENT DOCUMENTS

| | | | |
|---|---|---|---|
| 803890 | 7/1936 | France | 63/14.4 |

*Primary Examiner*—Renee S. Luebke
*Assistant Examiner*—F. Saether
*Attorney, Agent, or Firm*—Barlow & Barlow, Ltd.

[57] ABSTRACT

An ear clip is disclosed that includes a jaw hinged to a base member to which an ornament may be affixed. The jaw is provided with a spring tongue that engages the base member and normally urges the jaw in one direction. The end of the spring tongue is provided with a plurality of notches and the end portion is bent from a plane of the jaw at an obtuse angle to insure positive engagement of the base member with the notches. Additional depressions on the inner face of mounting or pivot ears may be provided for additional positive adjustable engagement.

4 Claims, 1 Drawing Sheet

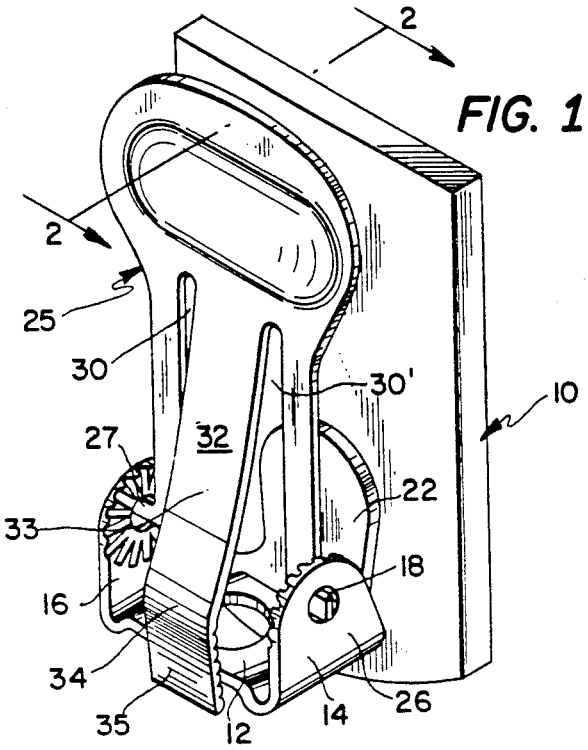
FIG. 1
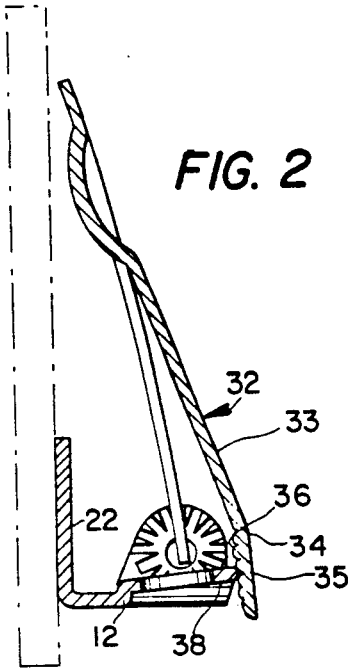
FIG. 2
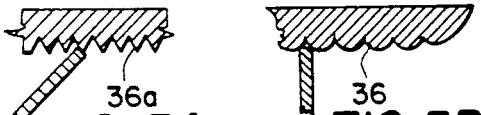
FIG. 5A
FIG. 5B
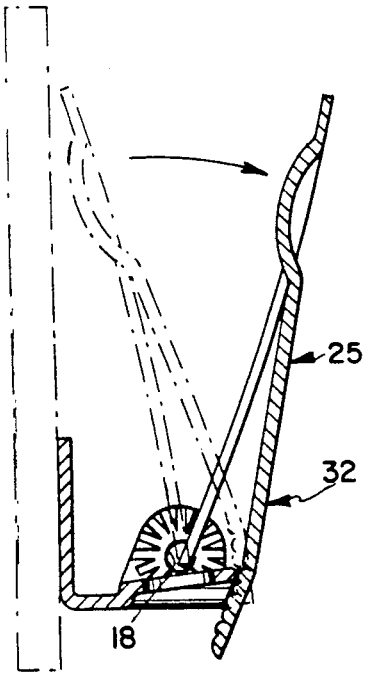
FIG. 3
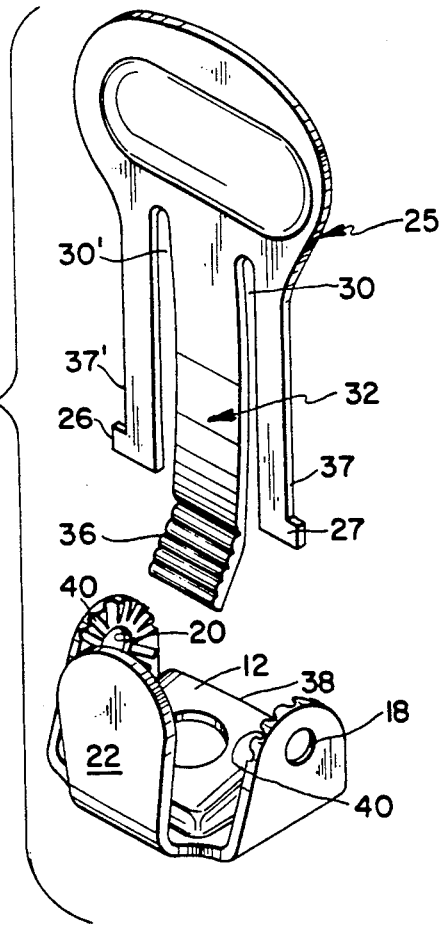
FIG. 4

ADJUSTABLE PRESSURE EAR CLIP

BACKGROUND OF THE INVENTION

Ear ornaments in common use today frequently comprise a pair of members which snap together under pressure. This clip action is utilized to retain the clip on the wearer's ear. In this type of construction, the spring pressure employed should be strong enough to suit different thicknesses of ear lobes and frequently, the spring pressure transferred to the wearer's ear is uncomfortable due to pinching the ear lobe or, on the other hand, in looseness and loss of the clip.

In the prior art, there have been a number of ear clips developed over the years but perhaps one of the more popular styles has been that as seen in the Ballou U.S. Pat. No. 2,583,988, and the Chernow U.S. Pat. No. 2,230,984. One of the difficulties with the prior art constructions has been that the clip that engages the ear when in the engaging position, exerts an amount of pressure that is consistent with the amount of spring temper that is found in the spring tongue thereof and is sometimes excessive. Some attempts have been made to solve the problem of excessive pressure as exemplified by McSoley U.S. Pat. No. 2,013,760 and adjustment of pressure as in Saccoccio U.S. Pat. No. 2,733,491 but have never met with commercial success.

SUMMARY OF THE INVENTION

The invention relates to an ear clip of a type that will provide a firm grip on the wearer's ear but without causing any discomfort. To this end, the clip has a pivoting jaw to which a spring tongue is made an integral part thereof, which spring tongue engages a portion of the mounting plate. Of greatest importance is the fact that the end of the spring tongue is bent at an angle out of the general plane thereof so that when engaging the mounting plate in its normal operating position, and with a plurality of notches that cut in the end of the spring tongue, the jaw will have a softer grip on the ear and give a more even tension throughout the working range of the jaw.

According to the present invention, the ear clip comprises a first member or "jaw" adapted to be pressed against one side of the lobe of an ear and a second member, including a pair of spaced pivot ears to which an ear ornament is attached, which pivot ears include a base plate member that will engage a portion of the jaw means which are provided with a series of notches bridged by smooth ramps and which has a spring tongue carrying the notches that is bent at an angle to the normal plane of the jaw means to provide a plurality of step engagements. In a further configuration of the present invention, the spaced pivot ears are provided with a plurality of notches which also cooperate to provide intermediate locations for the jaw means.

It is therefor the primary object of the invention to provide an ear clip which has a spring action for moving the gripping jaws together but which exhibits a more even tension throughout the working range of the spread of the jaws. This is achieved by the particular angle of the terminal end portion of the spring tongue.

DESCRIPTION OF THE DRAWINGS

FIG. 1 is a perspective view of an ear clip made in accordance with the invention;

FIG. 2 is a sectional view taken on lines 22 of FIG. 1;

FIG. 3 is a similar sectional view showing the jaws open;

FIG. 4 is a detached perspective view of the ear clip of the invention; and

FIGS. 5A and 5B are diagrammatic views illustrating the principle of the invention.

DESCRIPTION OF THE PREFERRED EMBODIMENT

Ear clips that are used for mounting ornaments on ears should desirably have an action of the part so as not to cause discomfort on the ear and yet, have a structure that will firmly grip the ear and maintain the ornament in place. With references specifically to the drawings, there may be provided an ornament which is shown generally diagrammatically and generally indicated 10 to which there will be attached a mounting member that consists of a base plate 12 having a pair of ears of side walls 14, 16 that extend at right angles to the base plate 12, which side walls are provided with pivot openings 18, 20. The structure also includes an end wall 22 that extends at generally a right angle to the base plate member 12 and to the end walls 14, 16. The member 22 serves as a mounting means for the ornamental portion, generally designated 10 which can be of any desired shape or form.

The jaw means generally designated 25 is provided with a pair of trunnions, 26, 27, which are pivotally received in the openings 18, 20 and the side walls 14, 16. The jaw body is provided with a pair of longitudinal slits or cut-out portions as at 30, 30' so as to provide a spring tongue 32. The tongue 32, as seen in the drawings, is longer than the body portion of the jaw and extends substantially beyond the axis of the trunnions 26, 27. The tongue includes a flat upper portion 33 and a flat lower portion 35 delineated by the bend as at 34 at an angle that can be described as obtuse or less that a straight angle where the lower portion 35 is provided with a plurality of transverse notches 36 that are connected by smooth ramps. The notches 36 engage the edge 38 of the base plate 12 (see FIG. 2) to essentially provide a friction catch arrangement. The angle between the base plate 12 and the notches is such that in the normal operative position as seen in FIG. 2, the edge of the base plate 12 at 38 and the notches 36 will be in positive engagement or in a mating relationship. If there were no angle, the edge of the base plate would line up with the ramp of the notch **36*a* as seen in FIG. 5A. However, when the notches 36 engage as seen in FIG. 5B**, the spring action of the tongue is not only relieved, but there is no slippage. It has been found that only with a spring tongue bent as shown, will positive engagement be achieved. Thus, the important features of the present invention are a bent tongue that in the operative position (the jaw slightly spaced from the ornament) will be substantially at right angles to the base plate and that the notches are connected by ramps to allow ease in the movement of the jaw. A further important feature of the invention resides in the terminal end of the spring tongue which is substantially smooth. Thus should the ear clip be entirely closed, that is the jaw resting on the ornament, the smooth terminal end will engage the base plate and permit ease in opening to engage the ear lobe.

The tension spring tongue is adjusted in manufacturing by tempering the metal of the jaw. To this end, the material of the jaw should preferably be a #8 to #10, spring tempered phosphor bronze, 0.025" sheet stock or a type 302 spring tempered stainless steel having a Rockwell hardness of C-40 to C-45. The use of a proper temper of material coupled with the fact that the notches created on the spring tongue 32 positively engage the edge of the base plate 12, creates a superior operating ear clip. This has heretofore not occurred due to the fact that in prior art clips the spring tongue is straight and there is a misalignment in the operative position. The tongue must therefore have its terminal end that contains the notches bent at an angle as illustrated. To understand this it should be noted that the operative position of an ear clip such as is disclosed will be between the positions of FIG. 2 and FIG. 3.

As an alternate additional feature, the side walls 14, 16 may be provided on their inner wall with radially extending depressions 40 connected by ramps. The outer edges of the jaw, as at 37, 37', engage the depressions 40 and provide additional positive engagement throughout the adjustment range. In effect, the additional depressions are effective as the ear clip operates in its clamping mode between the positions of FIGS. 2 and 3 as seen in the drawings. The depressions provided on the ears 14, 16 can be arranged in such a way by adjustment of the base plate 12, that they will provide a detent position in between the detent position of the notches 36 and thus, provide in the completed article a plurality of positions so that a comfortable pressure may be easily achieved.

It will be appreciated that there is disclosed a novel construction of an ear clip that is simple but effective in relieving pressure on the ear lobe. The engagement of the spring tongue grooves or the ear depressions, hold the jaw in any position that is comfortable and eliminates the constant pressure heretofore found objectionable.

I claim:

1. An ear clip comprising a pair of spaced ears at opposite edges of a base plate, said ears having apertures therein, a jaw means having pivot means at one end mounting the jaw for movement in said ears, said jaw having a spring tongue extending from the other end and consisting of a flat upper portion and a flat lower portion that extend at an angle less than a straight angle to each other, the lower flat portion of said spring tongue having a series of transverse notches interconnected by smooth arcuate ramps, whereby the lower portion of a plane of the jaw and said notches engage the base plate, substantially normal thereof in an ear engaging position.

2. An ear clip as in claim 1 wherein the jaw and the spring tongue have a controlled spring temper and are a #8 to #10 spring tempered phosphor bronze of suitable thickness.

3. An ear clip as in claim 1 wherein a terminal end of the spring tongue is smooth.

4. An ear clip comprising a pair of spaced ears at opposite edges of a base plate, said ears having apertures therein, a jaw means having pivot trunnion means at one end mounting the jaw for movement in said ears, the juxtaposed faces of the ears having a plurality of elongated depressions therein extending radially from the aperture, said jaw leaving a spring tongue extending from the other end and having a terminus extending at an angle less than a straight angle, said spring tongue having a series of transverse notches and said tongue normally deflected to extend out of the plane of the jaw to engage the base plate, said notches engaging the base plate to maintain equilibrium in an ear engaging position, the edges of the jaw above the trunnions engaging said depressions in said ears.

* * * * *